US006385778B1

(12) United States Patent
Johnson

(10) Patent No.: US 6,385,778 B1
(45) Date of Patent: May 14, 2002

(54) SHAPE ENHANCING HOSIERY

(76) Inventor: Dorothy L. Johnson, 1225 45th St. South, St. Petersburg, FL (US) 33711

( * ) Notice: Subject to any disclaimer, the term of this patent is extended or adjusted under 35 U.S.C. 154(b) by 0 days.

(21) Appl. No.: 09/881,886

(22) Filed: Jun. 15, 2001

(51) Int. Cl.[7] ..... A41B 11/00
(52) U.S. Cl. ..... 2/239; 2/240
(58) Field of Search ..... 2/239, 240, 241, 2/242, 61, 409, 22; 602/6

(56) References Cited

U.S. PATENT DOCUMENTS 1,693,141 A * 11/1928 Ducat
2,501,903 A * 3/1950 Huggins
3,191,185 A * 6/1965 Martin ..... 2/22
3,216,223 A * 11/1965 Margulies ..... 66/178
3,386,270 A * 6/1968 Simmons ..... 66/178
4,001,953 A * 1/1977 Fugere et al. ..... 36/2
4,624,015 A * 11/1986 Bottoms ..... 2/22
5,263,923 A * 11/1993 Fujimoto ..... 602/62
5,307,522 A * 5/1994 Throneburg et al. ..... 2/239
5,555,564 A * 9/1996 Welch ..... 2/239
5,774,898 A * 7/1998 Malpee ..... 2/239
5,867,839 A * 2/1999 Lawlor ..... 2/240
5,983,391 A * 11/1999 Palmer et al. ..... 2/16
6,125,665 A * 10/2000 Lonati et al. ..... 66/183
6,173,452 B1 * 1/2001 Kelly et al. ..... 2/240

* cited by examiner

*Primary Examiner*—John J. Calvert
*Assistant Examiner*—Alissa L. Hoey

(57) ABSTRACT

A shape enhancing hosiery for thickening and enhancing the shape and curvature of a wearer's legs includes a sleeve having a closed lower end, an open upper end, a curved plastic insert, and an adjustable strap coupled around the open end.

15 Claims, 2 Drawing Sheets

SHAPE ENHANCING HOSIERY

BACKGROUND OF THE INVENTION

1. Field of the Invention

The present invention relates to hosiery and more particularly pertains to a new shape enhancing hosiery for thickening and enhancing the shape and curvature of a wearer's legs.

2. Description of the Prior Art

The use of hosiery is known in the prior art. More specifically, hosiery heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,784,723; 5,842,232; 4,282,609; 5,509,282; 1,654,064; 4,745,917; U.S. Pat. No. Des. 243,643; and U.S. Pat. No. 3,128,475.

While these devices fulfill their respective, particular objectives and requirements, the aforementioned patents do not disclose a new shape enhancing hosiery. The inventive device includes a sleeve having a closed lower end, an open upper end, a curved plastic insert, and an adjustable strap coupled around the open end.

In these respects, the shape enhancing hosiery according to the present invention substantially departs from the conventional concepts and designs of the prior art, and in so doing provides an apparatus primarily developed for the purpose of thickening and enhancing the shape and curvature of a wearer's legs.

SUMMARY OF THE INVENTION

In view of the foregoing disadvantages inherent in the known types of hosiery now present in the prior art, the present invention provides a new shape enhancing hosiery construction wherein the same can be utilized for thickening and enhancing the shape and curvature of a wearer's legs.

The general purpose of the present invention, which will be described subsequently in greater detail, is to provide a new shape enhancing hosiery apparatus and method which has many of the advantages of the hosiery mentioned heretofore and many novel features that result in a new shape enhancing hosiery which is not anticipated, rendered obvious, suggested, or even implied by any of the prior art hosiery, either alone or in any combination thereof.

To attain this, the present invention generally comprises a sleeve having a closed lower end, an open upper end, a curved plastic insert, and an adjustable strap coupled around the open end.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shape enhancing hosiery apparatus and method which has many of the advantages of the hosiery mentioned heretofore and many novel features that result in a new shape enhancing hosiery which is not anticipated, rendered obvious, suggested, or even implied by any of the prior art hosiery, either alone or in any combination thereof.

It is another object of the present invention to provide a new shape enhancing hosiery that may be easily and efficiently manufactured and marketed.

It is a further object of the present invention to provide a new shape enhancing hosiery that is of a durable and reliable construction.

An even further object of the present invention is to provide a new shape enhancing hosiery which is susceptible of a low cost of manufacture with regard to both materials and labor, and which accordingly is then susceptible of low prices of sale to the consuming public, thereby making such shape enhancing hosiery economically available to the buying public.

Still yet another object of the present invention is to provide a new shape enhancing hosiery which provides in the apparatuses and methods of the prior art some of the advantages thereof, while simultaneously overcoming some of the disadvantages normally associated therewith.

Still another object of the present invention is to provide a new shape enhancing hosiery for thickening and enhancing the shape and curvature of a wearer's legs.

Yet another object of the present invention is to provide a new shape enhancing hosiery which includes a sleeve having a closed lower end, an open upper end, a curved plastic insert, and an adjustable strap coupled around the open end.

Still yet another object of the present invention is to provide a new shape enhancing hosiery that broadens and accentuates the curvature of the calf of a wearer.

Even still another object of the present invention is to provide a new shape enhancing hosiery that gives an appealing appearance of curvature to overly thin or shapeless calves.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
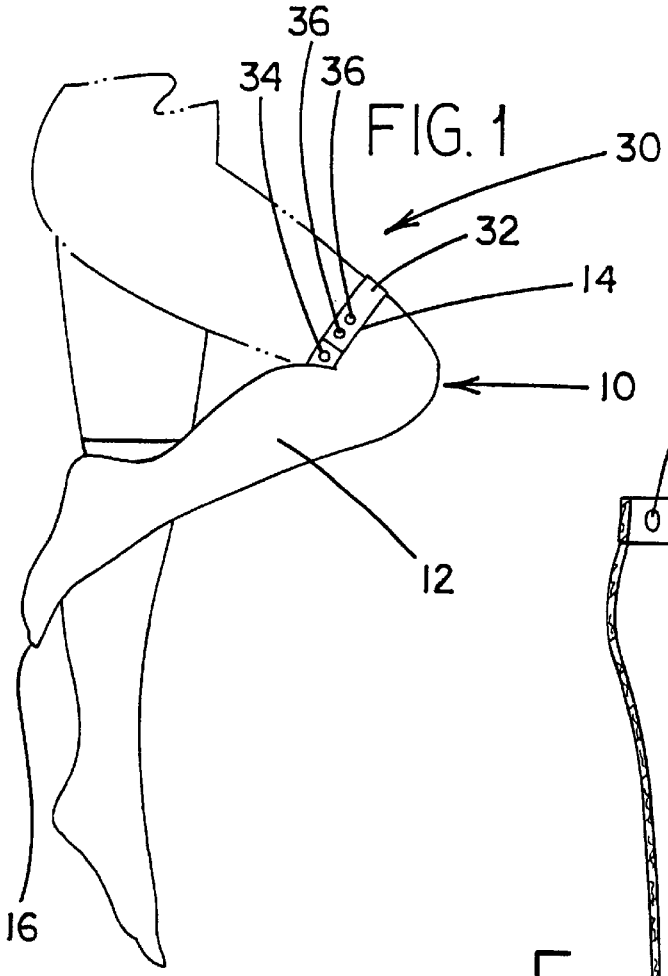
FIG. 1 is a front view of a new shape enhancing hosiery according to the present invention.

With reference now to the drawings, and in particular to FIGS. 1 through 4 thereof, a new shape enhancing hosiery embodying the principles and concepts of the present invention and generally designated by the reference numeral 10 will be described.

As best illustrated in FIGS. 1 through 4, the shape enhancing hosiery 10 generally comprises a flexible mesh sleeve 12 having an open end 14 and a closed end 16. The open end 14 is designed for receiving a wearer's leg therethrough.

The shape enhancing hosiery 10 further includes a generally curved plastic insert 20 having an interior surface 22 shaped to generally conform to an outer surface of a calf portion of the wearer's leg. The insert 20 also has an outer surface 24 generally curved and proportioned to have the outward appearance of a calf portion of a human leg.

The insert 20 is further defined as a generally elongated member having a generally C-shaped cross section taken perpendicular to a longitudinal axis of the insert 20.

The insert 20 also has a top 26 positioned within the sleeve 12 proximate the open end 14 and a bottom 28 positioned within the sleeve 12 proximate the bottom end 16.

A medial portion 25 of the insert 20 has a thickness tapering towards the top 26 and the bottom 28.

The thickness of the medial portion 25 is greater proximate the bottom 28 such that the insert 20 is designed to provide greater curvature enhancement proximate a lower portion of a wearer's calf.

The shape enhancing hosiery 10 also includes an adjustable strap 30. The adjustable strap 30 most preferably includes an elastic band 32 having a first end, a second end, and a lower edge coupled to the top of the flexible sleeve 12. A first snap member 34 is coupled to the elastic band at the first end of the elastic band 32 and a plurality of second snap members 36 are positioned in spaced relationship to each other extending away from the second end of the elastic band 32. The first snap member 34 is positioned for selectively coupling to a selected one of the second snap members 36 such that the elastic band 32 forms a loop around the wearer's leg. The first snap member 34 and the selected second snap member 36 are engageable to each other such that a circumference of the elastic band 32 is lessened when the first snap member 34 and the selected second snap member 36 are engaged to each other whereby the elastic band is adjustably tightened around the leg of a wearer. It is also contemplated that only a pair of snap members may be employed such that only one second snap member is provided proximate the second end of the strap 32.

Figure 2:
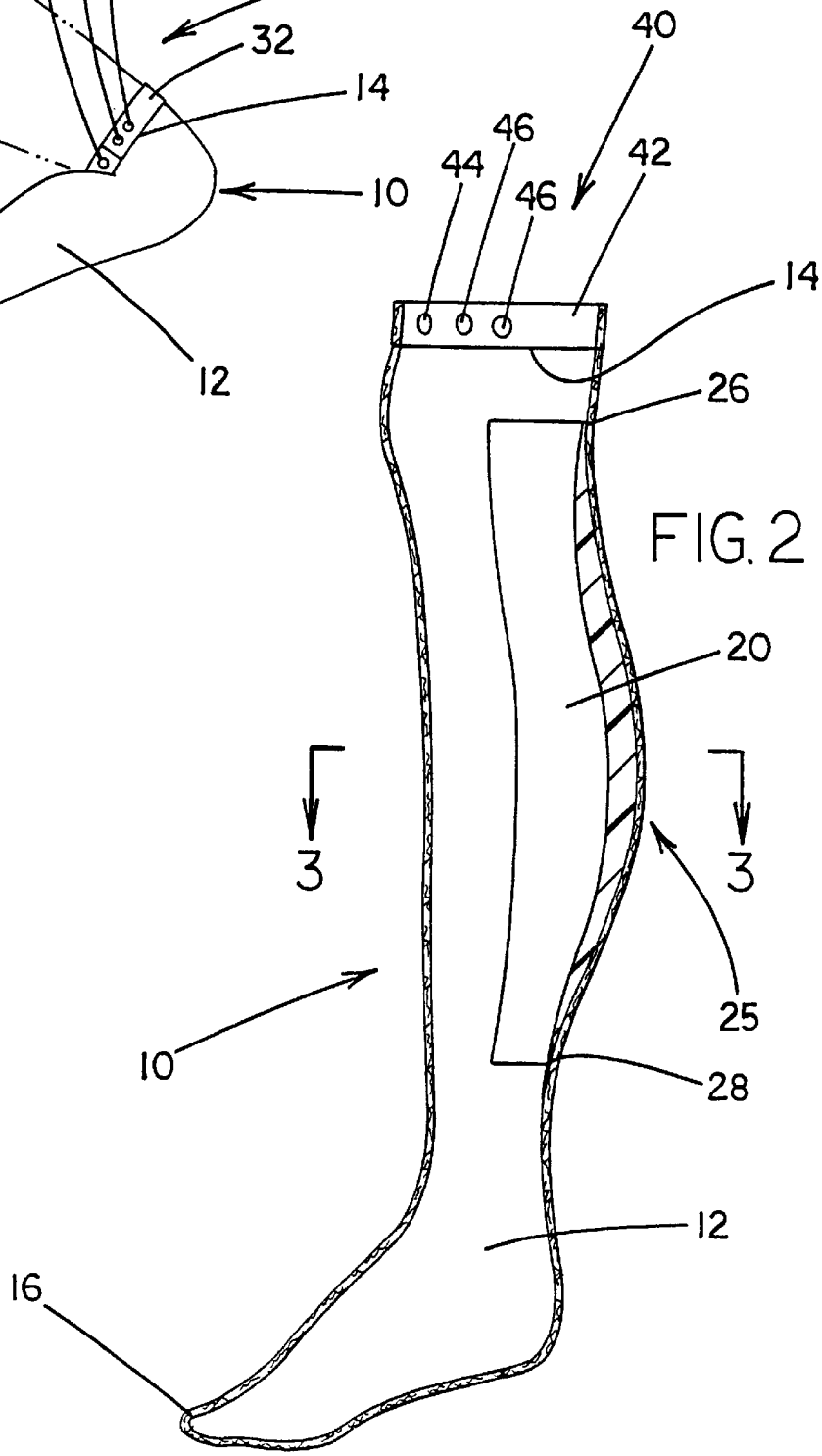
FIG. 2 is a side view of the present invention having an alternate adjustable strap arrangement.
Figure 3:
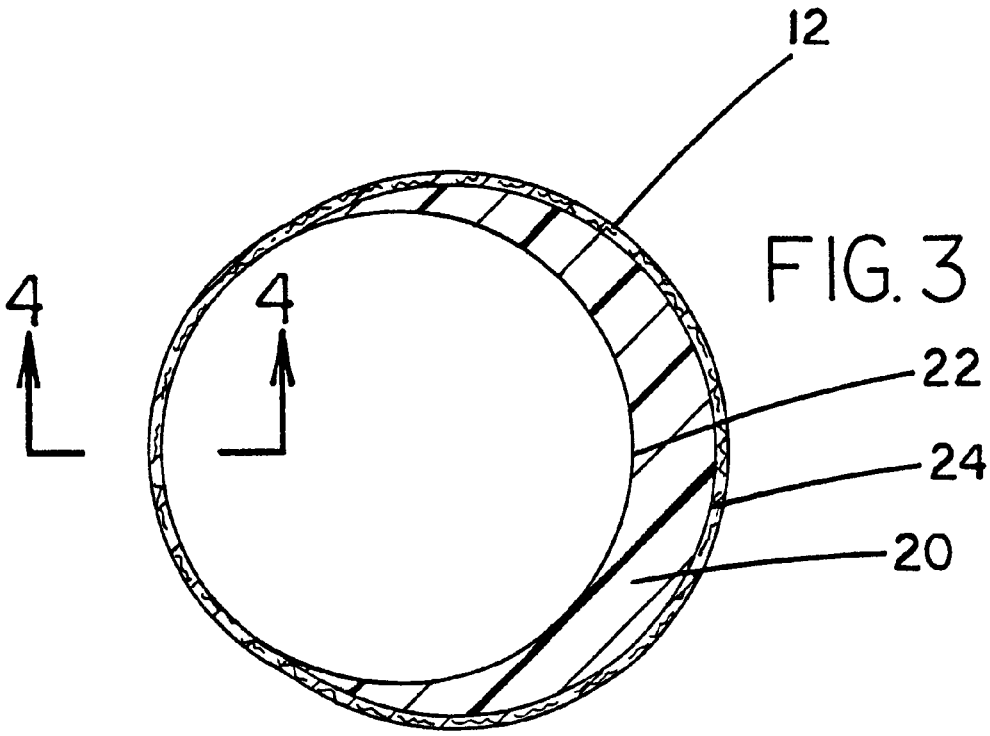
FIG. 3 is a cross-sectional view of the present invention taken along line 3—3 of FIG. 2.
Figure 4:
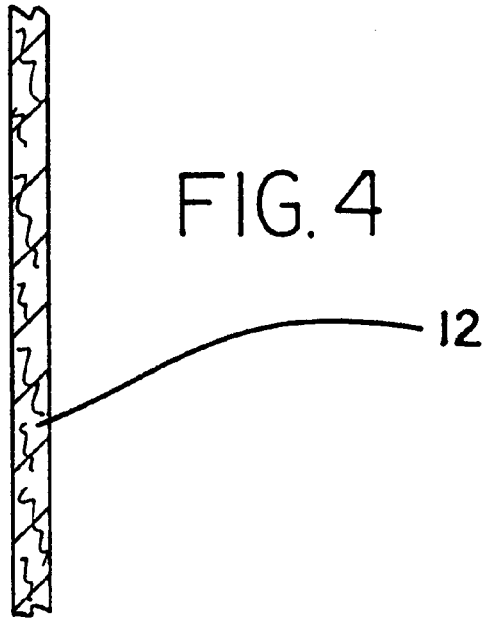
FIG. 4 is a cross-sectional view of the sleeve material of the present invention taken along line 4—4 of FIG. 3.

An alternate embodiment of the adjustable strap 30 is shown more particularly in FIG. 2. The alternate strap 40 includes an elastic band 42 formed into a loop having a lower edge coupled to the top of the flexible sleeve 12. A pair of snap members 44 and 46 are positioned on an outer surface of the elastic band 42 such that the snap members 44 and 46 do not abrade the leg of the wearer. It is also contemplated that a plurality of second snap members 46 may be provided in spaced relationship to each other similar to second snap members 36 such that the alternate embodiment also provides additional degrees of adjustability depending on the selection of the second snap member 46 engaged to snap member 44.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shape enhancing hosiery comprising:

a flexible mesh sleeve having an open end and a closed end, the open end being for receiving a wearer's leg therethrough;

a removable generally curved elongated plastic insert having an interior surface shaped to generally conform to an outer surface of a calf portion of the wearer's leg, the insert further having an outer surface generally curved and proportioned to have the outward appearance of a calf portion of a human leg;

an entirety of said outer surface of said curved elongated plastic insert being continuously smooth and contacting an interior surface of said flexible mesh sleeve such that said curved elongated plastic insert is held in position by compression of said flexible mesh sleeve around said curved elongated plastic insert and the wearer's leg; and an adjustable strap coupled to the open end of the sleeve for securing the open end of the sleeve to a thigh of the wearer.

2. The shape enhancing hosiery of claim 1 wherein said insert further comprises a generally C-shaped cross section taken perpendicular to a longitudinal axis of the elongated member.

3. The shape enhancing hosiery of claim 2 wherein said insert further comprises said elongated member having a top and a bottom; and said top being positioned within said sleeve proximate said open end and said bottom being positioned within said sleeve proximate said bottom end.

4. The shape enhancing hosiery of claim 3 wherein said elongated member further comprises a medial portion, said medial portion having a thickness, said thickness tapering towards said top and said bottom.

5. The shape enhancing hosiery of claim 4, wherein said thickness of said medial portion is greater proximate said bottom such that said insert is adapted to provide greater curvature enhancement proximate a lower portion of a wearer's calf.

6. The shape enhancing hosiery of claim 1 wherein said flexible mesh sleeve is translucent and said insert is colored to generally match the flesh tone of the wearer.

7. The shape enhancing hosiery of claim 1 wherein the flexible mesh sleeve is opaque.

8. The shape enhancing hosiery of claim 1 wherein said adjustable strap comprises:

an elastic band having a lower edge, said lower edge being coupled to said top of said flexible sleeve;

a pair of snap members coupled to said elastic band, said snap members being for selectively coupling to each other such that a circumference of said elastic band is lessened when said snap members are engaged to each other whereby said elastic band is tightened around the leg of a wearer.

9. The shape enhancing hosiery of claim 8 wherein said snap members are positioned on an outer surface of said elastic band such that said snap members do not abrade the leg of the wearer.

10. The shape enhancing hosiery of claim 1 wherein said adjustable strap comprises:

an elastic band having a lower edge, said lower edge being coupled to said top of said flexible sleeve;

a first snap member and a plurality of spaced second snap members, said first snap member and said second snap members being coupled to said elastic band, said first snap members being for selectively coupling to a selected one of said second snap members such that a circumference of said elastic band is lessened when said first snap member is engaged to said selected second snap member whereby said elastic band is tightened around the leg of a wearer.

11. The shape enhancing hosiery of claim 1 wherein said adjustable strap comprises:

an elastic band having a first end, a second end, and a lower edge, said lower edge being coupled to said top of said flexible sleeve;

a pair of snap members coupled to said elastic band at opposing ends of said elastic band, said snap members being positioned for selectively coupling to each other such that said elastic band forms a loop, said snap members being engageable such that a circumference of said elastic band is lessened when said snap members are engaged to each other whereby said elastic band is tightened around the leg of a wearer.

12. The shape enhancing hosiery of claim 1 wherein said adjustable strap comprises:

an elastic band having a first end, a second end, and a lower edge, said lower edge being coupled to said top of said flexible sleeve;

a first snap member coupled to said elastic band at said first end of said elastic band and a plurality of second snap members positioned in spaced relationship to each other extending away from said second end of said elastic band, said first snap member being positioned for selectively coupling to a selected one of said second snap members such that said elastic band forms a loop, said first snap member and said selected second snap member being engageable such that a circumference of said elastic band is lessened when said first snap member and said selected second snap member are engaged to each other whereby said elastic band is tightened around the leg of a wearer.

13. A shape enhancing hosiery comprising:

a flexible mesh sleeve having an open end and a closed end, the open end being for receiving a wearer's leg therethrough;

a removable generally curved elongated plastic insert having an interior surface shaped to generally conform to an outer surface of a calf portion of the wearer's leg, the insert further having an outer surface generally curved and proportioned to have the outward appearance of a calf portion of a human leg;

an entirety of said outer surface of said curved elongated plastic insert being continuously smooth and contacting an interior surface of said flexible mesh sleeve such that said curved elongated plastic insert is held in position by compression of said flexible mesh sleeve around said curved elongated plastic insert and the wearer's leg;

an adjustable strap coupled to the open end of the sleeve for securing the open end of the sleeve to a thigh of the wearer;

wherein said insert further comprises a generally C-shaped cross section taken perpendicular to a longitudinal axis of the elongated member;

wherein said insert further comprises said elongated member having a top and a bottom;

said top being positioned within said sleeve proximate said open end and said bottom being positioned within said sleeve proximate said bottom end;

wherein said elongated member further comprises a medial portion, said medial portion having a thickness, said thickness tapering towards said top and said bottom;

wherein said thickness of said medial portion is greater proximate said bottom such that said insert is adapted to provide greater curvature enhancement proximate a lower portion of a wearer's calf; and wherein said adjustable strap comprises:

an elastic band having a first end, a second end, and a lower edge, said lower edge being coupled to said top of said flexible sleeve; and a first snap member coupled to said elastic band at said first end of said elastic band and a plurality of second snap members positioned in spaced relationship to each other extending away from said second end of said elastic band, said first snap member being positioned for selectively coupling to a selected one of said second snap members such that said elastic band forms a loop, said first snap member and said selected second snap member being engageable such that a circumference of said elastic band is lessened when said first snap member and said selected second snap member are engaged to each other whereby said elastic band is tightened around the leg of a wearer.

14. The shape enhancing hosiery of claim 13 wherein said flexible mesh sleeve is translucent and said insert is colored to generally match the flesh tone of the wearer.

15. The shape enhancing hosiery of claim 13 wherein the flexible mesh sleeve is opaque.

* * * * *